US008807868B2

(12) United States Patent
Schlenker et al.

(10) Patent No.: US 8,807,868 B2
(45) Date of Patent: Aug. 19, 2014

(54) ADJUSTABLE SIZING BAR FOR ROTARY MIXERS

(71) Applicants: Brian J. Schlenker, Plymouth, MN (US); Jason W. Muir, Andover, MN (US)

(72) Inventors: Brian J. Schlenker, Plymouth, MN (US); Jason W. Muir, Andover, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 3 days.

(21) Appl. No.: 13/717,777

(22) Filed: Dec. 18, 2012

(65) Prior Publication Data

US 2014/0169882 A1 Jun. 19, 2014

(51) Int. Cl.
*E01C 19/02* (2006.01)

(52) U.S. Cl.
USPC ..... 404/92

(58) Field of Classification Search
USPC ..... 404/92, 94, 93; 299/39.2
See application file for complete search history.

(56) References Cited

U.S. PATENT DOCUMENTS

| | | | | |
|---|---|---|---|---|
| 6,247,757 | B1 | 6/2001 | Cochran et al. | |
| 7,325,881 | B2 | 2/2008 | Cochran et al. | |
| 7,370,916 | B2 | 5/2008 | Ley et al. | |
| 7,976,239 | B2 * | 7/2011 | Hall et al. | 404/94 |
| 8,002,360 | B2 | 8/2011 | Cochran et al. | |
| 8,545,128 | B2 * | 10/2013 | Weiler | 404/92 |
| 2012/0179339 | A1 | 7/2012 | Busley et al. | |
| 2013/0287494 | A1 * | 10/2013 | Schlenker et al. | 404/72 |

* cited by examiner

*Primary Examiner* — Gary Hartmann
(74) *Attorney, Agent, or Firm* — Andrew A. Phillips

(57) ABSTRACT

A machine for receiving a ground layer, breaking up the ground layer into pieces, and producing a reclaimed layer incorporating the pieces, the machine including: a frame; a rotor coupled to the frame; a mixing chamber coupled to the frame and at least partially surrounding the rotor, the mixing chamber having an interior surface; a first member coupled to the interior surface and having an edge, the first member being moveable between a first position and a second position; and a gap length between the edge and the rotor, the gap length including: a first length when the first member is in the first position; and a second length when the first member is in the second position, the second length being greater than the first length.

14 Claims, 4 Drawing Sheets

ADJUSTABLE SIZING BAR FOR ROTARY MIXERS

TECHNICAL FIELD

Embodiments of the present disclosure pertain to a rotary mixer and, more particularly, to an apparatus for material gradation control.

BACKGROUND

A rotary mixer may be used as a soil stabilizer to cut, mix, and pulverize native in-place soils with additives or aggregates to modify and stabilize the soil for a strong base.

A rotary mixer may also be used as a road reclaimer to pulverize a surface layer, such as asphalt, and can mix it with an underlying base to create a new road surface and stabilize deteriorated roadways. Optionally, a rotary mixer can add asphalt emulsions or other binding agents to create a new road surface during pulverization or during a separate mix pass.

In a conventional rotary mixer, an operator may visually inspect the milled (or reclaimed) surface and manually adjust the speed of the rotor, and/or the front and rear doors to adjust the degree of pulverization of the milled surface. By closing the rear door, more material is held within the chamber. Traditionally, this is what an operator uses for fine adjustments of gradation. But by closing the rear door to hold more material, the machine requires more power to turn the rotor through that material, which causes the machine to travel slower.

U.S. Pat. No. 5,190,398 issued to Swisher, Jr. on Mar. 2, 1993, discloses an apparatus for pulverizing a surface such as a road and a system for adding liquid to the surface being pulverized.

A conventional rotary mixer may also include a breaker bar that controls the degree of pulverization of the milled surface. The breaker bar is fixed, so that it is not possible to adjust the degree of pulverization.

SUMMARY

One aspect of the present disclosure is directed to a machine for receiving a ground layer, breaking up the ground layer into pieces, and producing a reclaimed layer incorporating the pieces, the machine including: a frame; a rotor coupled to the frame; a mixing chamber coupled to the frame and at least partially surrounding the rotor, the mixing chamber having an interior surface; a first member coupled to the interior surface and having an edge, the first member being moveable between a first position and a second position; and a gap length between the edge and the rotor, the gap length including: a first length when the first member is in the first position; and a second length when the first member is in the second position, the second length being greater than the first length.

Another aspect of the present disclosure is directed to a rotary mixer for receiving a ground layer, breaking up the ground layer into pieces, and producing a reclaimed layer incorporating the pieces, the rotary mixer including: a rotor; a mixing chamber at least partially surrounding the rotor and having an interior surface; and a first member coupled to the interior surface and having an edge, the first member being moveable between a first position at which the edge is a first distance from the rotor and a second position at which the edge is a second distance from the rotor, the second distance being greater than the first distance.

Another aspect of the present disclosure is directed to an adjustable sizing mechanism for a machine having a mixing chamber and a ground-engaging rotor, the adjustable sizing mechanism including: a first member having an edge; means for coupling the first member to the rotor chamber; and means for moving the edge from a first position to a second position.

Other features and aspects of this disclosure will be apparent from the following description and the accompanying drawings.

DETAILED DESCRIPTION

Exemplary embodiments of the present disclosure are presented herein with reference to the accompanying drawings. Herein, like numerals designate like parts throughout.

Figure 1:
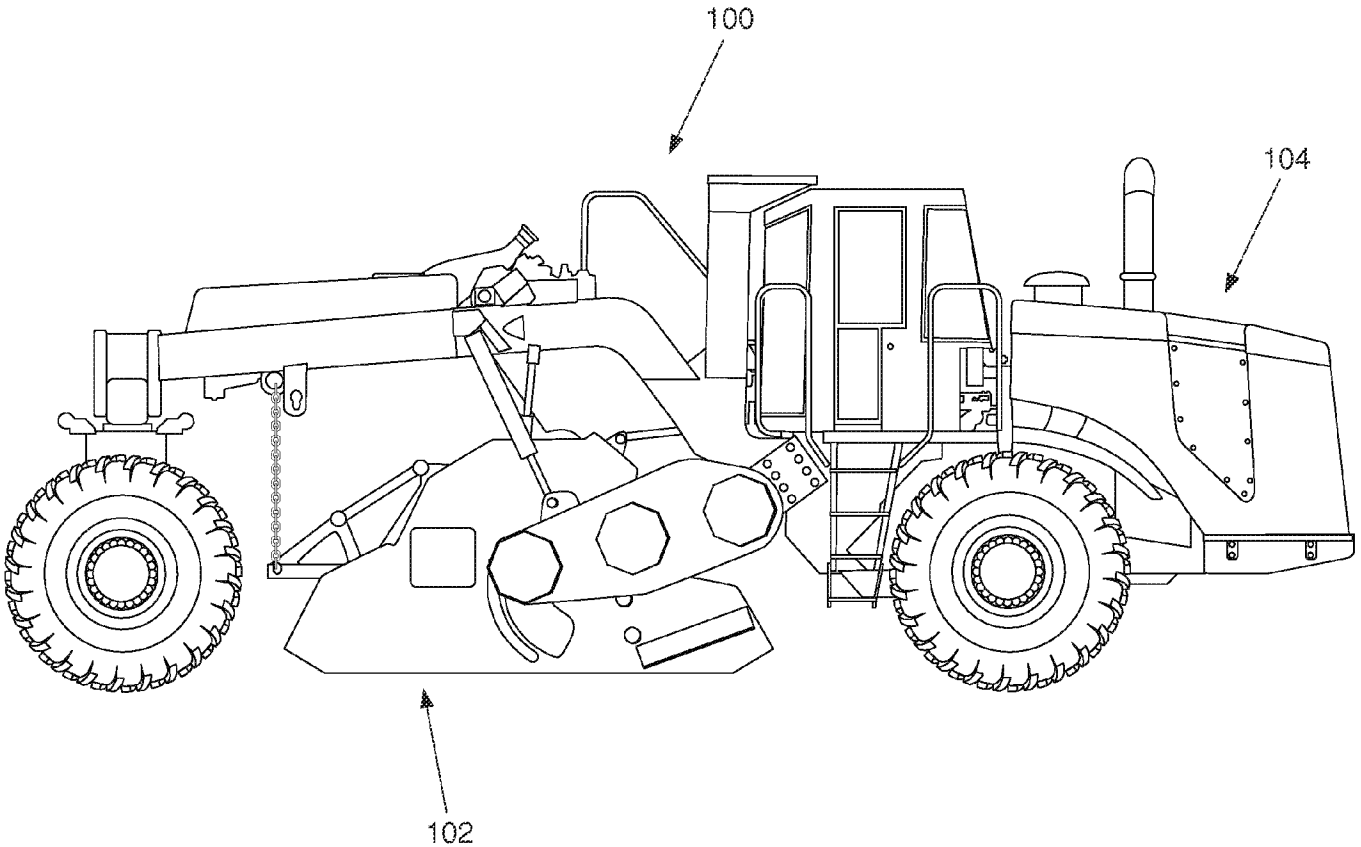
FIG. 1 illustrates an exemplary machine having a mixing chamber.

FIG. 1 illustrates an exemplary machine 100, in this case, a rotary mixer. Although FIG. 1 shows a rotary mixer, any other machine used in road reclamation, soil stabilization, surface pulverization, or other applications is contemplated by the present disclosure. According to FIG. 1, the machine 100 includes a mixing chamber 102 and a frame 104.

Figure 2:
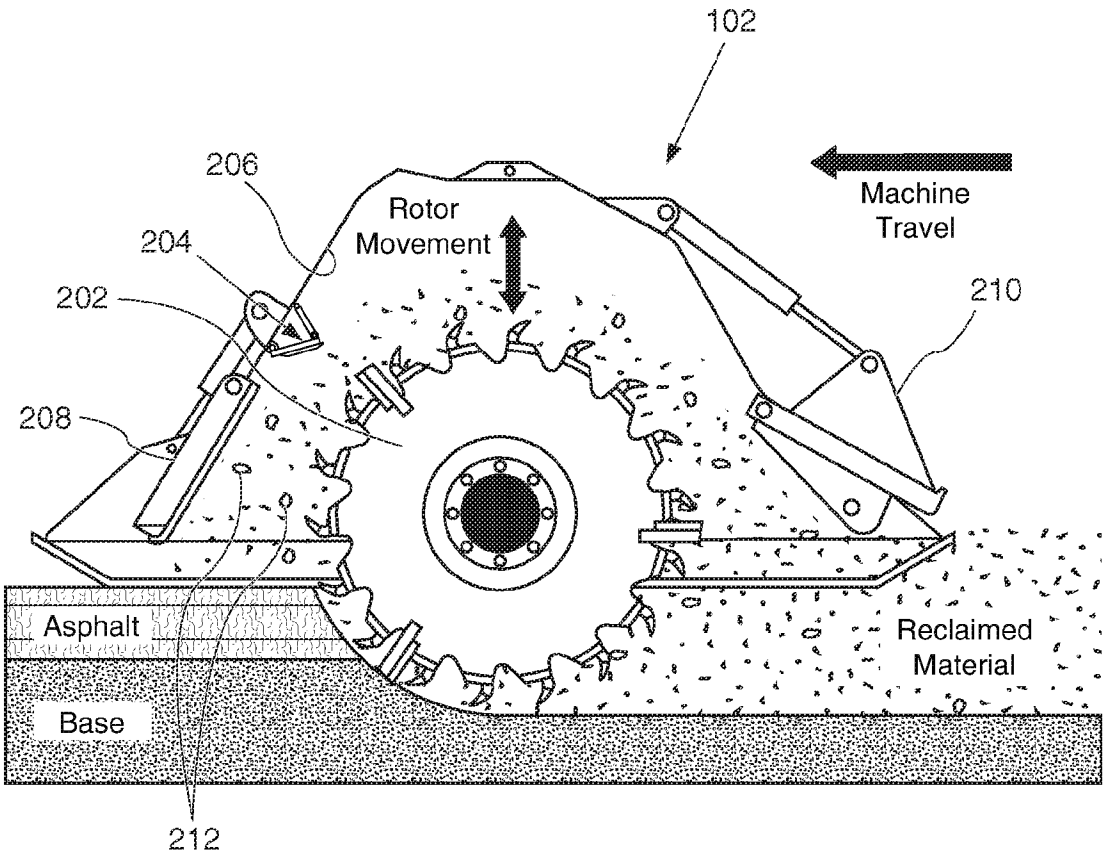
FIG. 2 illustrates the mixing chamber of the exemplary machine shown in FIG. 1.

FIG. 2 illustrates a mixing chamber 102 of machine 100. Mixing chamber 102 includes a rotor 202, an adjustable sizing mechanism 204, an interior surface 206, a front door 208, and a rear door 210. As shown in FIG. 2, as machine 100 and mixing chamber 102 move along the ground, rotor 202 breaks apart and pulverizes an asphalt and base layer into pieces 212, and pieces 212 are then used to form a layer of reclaimed material. One of skill in the art will appreciate that while FIG. 2 shows an asphalt layer and a base layer, the present disclosure is applicable to other layers found during road reclamation.

The position of front door 208, rear door 210, and the speed of rotor 202 affects the degree of pulverization by regulating the amount, direction, and speed of material flow through mixing chamber 102. Adjustable sizing mechanism 204 is also used to control the degree of pulverization of pieces 212. Adjustable sizing mechanism 204, as will be described below, may be positioned at various distances from rotor 202 to set the degree of pulverization or, in other words, to set the maximum size or diameter of pieces 212 used in the layer of reclaimed material.

Figure 3:
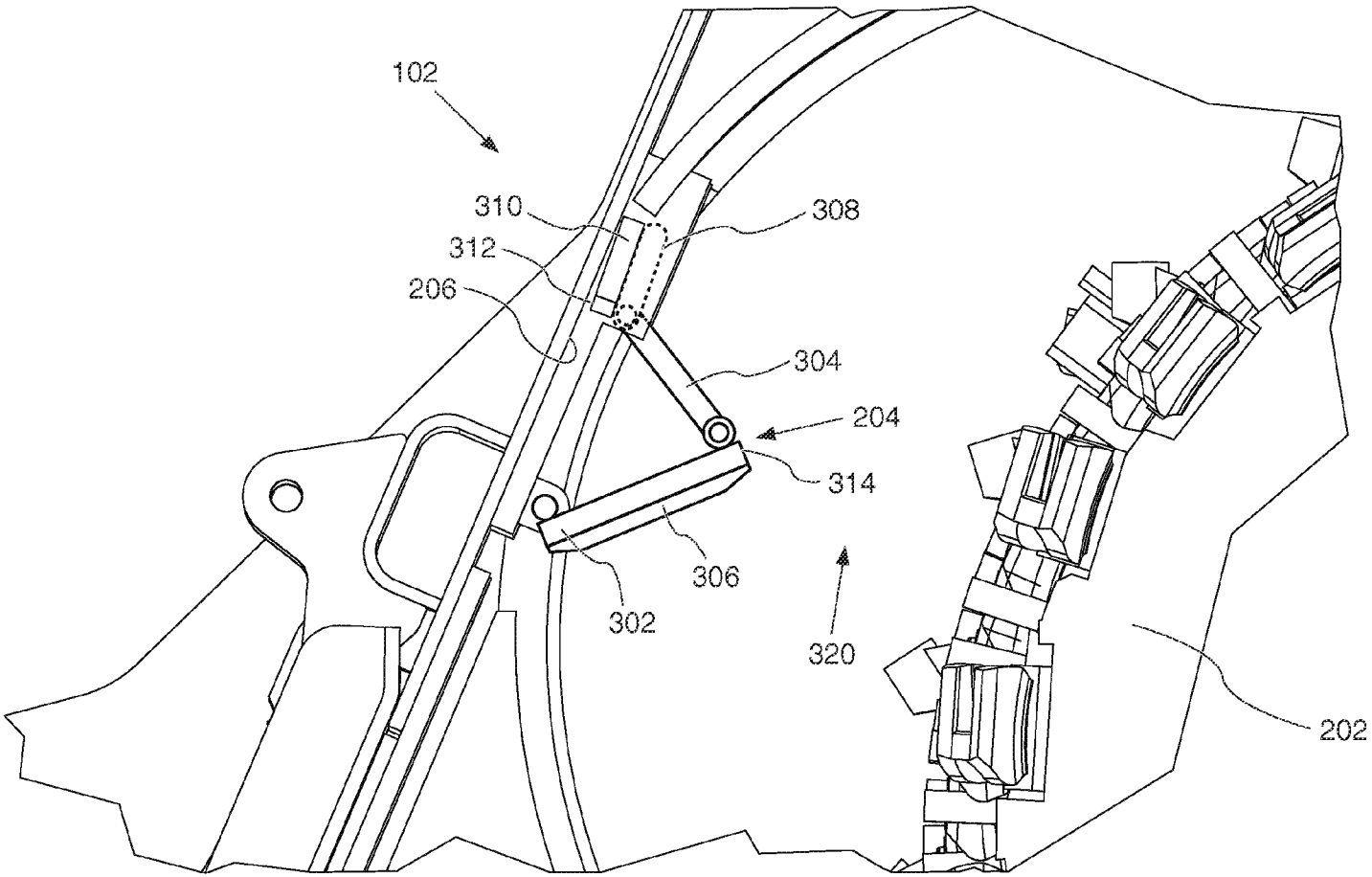
FIGS. 3 and 4 illustrate an exemplary adjustable sizing mechanism coupled to the interior surface of a mixing chamber.

FIG. 3 shows adjustable sizing mechanism 204 in a first position. Adjustable sizing mechanism 204 contains a first member 302, a second member 304, a third member 306, and an edge 314. First member 302 is coupled to interior surface 206 by, for example, a hinge that allows first member 302 to pivot from a position fixed on interior surface 206. First member 302 and second member 304 are coupled to each other by, for example, a hinge. Second member 304 is coupled to interior surface 206 by, for example, a track 308. Track 308 can either be built into interior surface 206 or coupled to interior surface 206. An end of second member 304 moves along track 308, thereby slidably coupling that end of second member 304 to interior surface 206. In alternative embodiments, second member 304 could be coupled to interior surface 206 by other methods, so long as first member 302 was able to move relative to interior surface 206. Second member 304 helps to hold first member 302, and therefore the edge 314, in place.

Third member 306 may optionally be connected to first member 302. Third member 306 is constructed of a resilient and protective material and is placed between the first member 302 and the ground layer, to protect the first member 302 from sustaining damage from pieces 212. Third member 306 may be coupled to first member 302, for example by bolting or riveting, so that it can be easily removed and replaced if damaged or worn. Alternatively, first member 302 and third member 306 could be provided with grooves or slots that would allow third member 306 to slide onto first member 302 and lock in place. It is anticipated that third member 306 would need to be replaced from wear depending on the amount of time machine 100 is conducting pulverizing operations.

Adjustable sizing mechanism 204 may also contain an actuator 310 and a sensor 312 coupled to interior surface 206. Actuator 310 links the adjustable sizing mechanism 204 to the hydraulic system of machine 100 so that adjustable sizing mechanism 204 is moved by operation of the hydraulic system of machine 100. Alternatively, actuator 310 may optionally be located in either first member 302, second member 304, or on other locations of mixing chamber 102 or interior surface 206. One of skill in the art will appreciate that adjustable sizing mechanism 204 may be moved by other means than hydraulic actuation. For example, adjustable sizing mechanism 204 may be moved by hand, by a chain gear, or by other methods known in the art.

Adjustable sizing mechanism 204 is coupled to interior surface 206 in such a way that a gap 320 is formed between adjustable sizing mechanism 204 and rotor 202. The length of gap 320 determines the maximum diameter of pieces 212. The length of gap 320 is defined by the distance between rotor 202 and adjustable sizing mechanism 204. For example, the length of gap 320 may be determined by measuring the distance from edge 314 of first member 302 to rotor 202. Sensor 312, coupled to actuator 310, uses actuator 310 to determine the position of the edge 314. That is, sensor 312 measures the actuation of actuator 310. The actuation of actuator 310 corresponds to a location of the edge 314. According to various alternative embodiments, actuator 310 may be a variety of different types of actuators, such as hydraulic cylinders or screw-type actuators.

Alternatively, sensor 312 could be located on track 308 itself, on edge 314, in the hinge rotatably coupling first member 302 to interior surface 206, or on numerous other portions of adjustable sizing mechanism 204, mixing chamber 102, or interior surface 206 such that the output from sensor 312 could be used to calculate the position of edge 314. For example, if the actuator 310 was located in the second member 304, the sensor 312 could also be in second member 304.

A second sensor (not shown) may be located on rotor 202. Rotor 202 is often configured to move up or down in mixing chamber 102, along a known path, and since rotor 202 has a fixed diameter, the second sensor could be used to sense the height of rotor 202 to know the position of rotor 202. Then, a comparison can be made between sensor 312 and the second sensor to measure the length of gap 320.

In FIG. 3, adjustable sizing mechanism 204 is shown in a first position where second member 304 is at one end of track 308. In this first position, the length of gap 320 is minimized, as edge 314 is in the position closest to rotor 202. When adjustable sizing mechanism 204 is in this first position, the maximum diameter of pieces 212 will be as small as mixing chamber 102 can produce.

Figure 4:
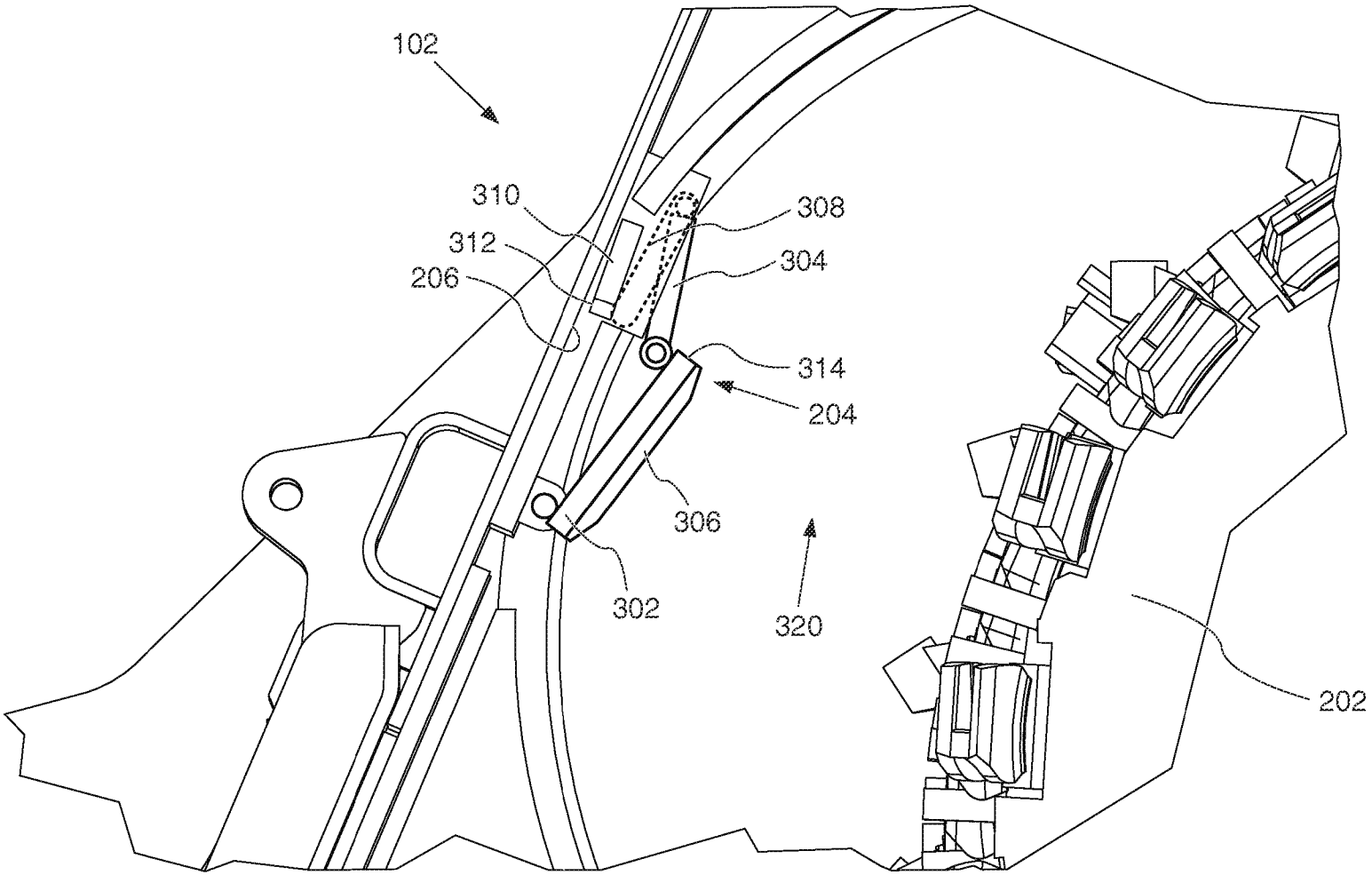

FIG. 4 shows adjustable sizing mechanism 204 in a second position with the same components described with respect to FIG. 3. In this second position, second member 304 of adjustable sizing mechanism 204 is at the other end of track 308 from that shown in FIG. 3. In this second position, the length of gap 320 is maximized, as edge 314 is in the position farthest from rotor. When adjustable sizing mechanism 204 is in this second position, the maximum diameter of pieces 212 will be as large as mixing chamber 102 can produce.

INDUSTRIAL APPLICABILITY

The present disclosure contemplates that the length of gap 320, which is calculated based on the signal received from sensor 312 and the second sensor, would be communicated to the operator of machine 100. This information may be communicated either through wired or wireless communication systems well known in the art. With this length of gap 320 information, the operator of machine 100 would be able to move adjustable sizing mechanism 204 to a desired length of gap 320 to control the maximum diameter of pieces 212. Potentially, the length of gap 320 could be displayed on a control panel in the operator station of machine 100 or on a remote control that the operator could use if observing machine 100 and mixing chamber 102 from the ground. The control panel in the operator station and/or the remote control may also be equipped with controls to allow the operator to move adjustable sizing mechanism 204 to the desired length of gap 320.

By having adjustable sizing mechanism 204 on interior surface 206 of mixing chamber 102 of machine 100, the performance of machine 100 may be enhanced. The operator of machine 100 will now have far greater control over material gradation and can even make adjustments during operation of machine 100. Adjustable sizing mechanism 204 generally provides the operator with the ability to adjust the diameter of pieces 212 based on a variety of conditions. This is a benefit since one reclaiming job may require a different maximum diameter of pieces 212 than a second reclaiming job.

One of ordinary skill in the art will appreciate that while the adjustable sizing mechanism 204 has been described having a first member 302, a second member 304, and a third member 306, that an adjustable sizing mechanism may have only a single member or it may have a plurality of members. The present disclosure should not be read to limit the adjustable sizing mechanism to having three members. Likewise, while FIGS. 2-4 have shown adjustable sizing mechanism 204 located at a specific point of interior surface 206, the present disclosure contemplates that adjustable sizing mechanism 204 may be located anywhere along interior surface 206 of mixing chamber 102. Additionally, while adjustable sizing mechanism 204 has been described as an apparatus that couples with the interior surface 206 of mixing chamber 102, one of skill in the art will appreciate that adjustable sizing mechanism 204 may be coupled to other parts of mixing chamber 102 within interior surface 206, and be actuated to move in and out of interior surface 206 to change the length of gap 320.

Although certain embodiments have been illustrated and described herein for purposes of description, it will be appreciated by those of ordinary skill in the art that a wide variety of alternate and/or equivalent embodiments or implementations calculated to achieve the same purposes may be substituted for the embodiments shown and described without departing from the scope of the present disclosure. Those with skill in the art will readily appreciate that embodiments in accordance with the present invention may be implemented in a very wide variety of ways. This application is intended to cover any adaptations or variations of the embodiments discussed herein. Therefore, it is intended that embodiments in accordance with the present invention be limited only by the claims and the equivalents thereof.

What is claimed is:

1. A machine configured to receive a ground layer, break up the ground layer into pieces, and produce a reclaimed layer incorporating the pieces, comprising:

a frame;

a rotor coupled to the frame;

a mixing chamber coupled to the frame and at least partially surrounding the rotor, the mixing chamber having an interior surface;

a first member coupled to the interior surface and having an edge, the first member being movable between a first position and a second position; and a gap length between the edge and the rotor, the gap length comprising:

a first length when the first member is in the first position; and a second length when the first member is in the second position, the second length being greater than the first length.

2. The machine of claim 1, further comprising:

a second member coupled to the first member.

3. The machine of claim 2, wherein the interior surface comprises a track, and wherein the second member engages the track.

4. The machine of claim 3, further comprising:

a third member coupled to the first member and positioned between the ground layer and the first member.

5. The machine of claim 4, further comprising:

an actuator configured to move the second member within the track between a first position and a second position.

6. The machine of claim 5, wherein the movement of the second member to the first position moves the first member to the first position and the movement of the second member to the second position moves the first member to the second position.

7. The machine of claim 6, further comprising:

a sensor configured to sense the actuation of the actuator.

8. A rotary mixer, configured to receive a ground layer, break up the ground layer into pieces, and produce a reclaimed layer incorporating the pieces, comprising:

a rotor;

a mixing chamber at least partially surrounding the rotor and having an interior surface; and a first member coupled to the interior surface and having an edge, the first member being moveable between a first position at which the edge is a first distance from the rotor and a second position at which the edge is a second distance from the rotor, the second distance being greater than the first distance.

9. The rotary mixer of claim 8, further comprising:

a second member rotatably connected to the first member.

10. The rotary mixer of claim 9, wherein the interior surface comprises a track, and the second member engages the track and moves the first member between the first position and the second position.

11. The rotary mixer of claim 10, further comprising:

an actuator configured to move the second member within the track.

12. The rotary mixer of claim 11, wherein the first member is moveable to any location in between the first position and the second position.

13. The rotary mixer of claim 12, further comprising:

a third member coupled to the first member and positioned between the ground layer and the first member.

14. The rotary mixer of claim 13, further comprising:

a sensor configured to sense the actuation of the actuator.

* * * * *